US012758029B2

(12) United States Patent
DeFranks et al.

(10) Patent No.: US 12,758,029 B2
(45) Date of Patent: Oct. 13, 2026

(54) ACTIVE COMFORT CONTROLLED BEDDING SYSTEMS

(71) Applicant: DREAMWELL, LTD., Atlanta, GA (US)

(72) Inventors: Michael S. DeFranks, Atlanta, GA (US); Brian Mark Anderson, Atlanta, GA (US); William Andrew Pahner, Brookhaven, GA (US); Victor Ray Prince, Jr., Chamblee, GA (US)

(73) Assignee: DREAMWELL, LTD., Doraville, GA (US)

( * ) Notice: Subject to any disclaimer, the term of this patent is extended or adjusted under 35 U.S.C. 154(b) by 2 days.

(21) Appl. No.: 18/168,952

(22) Filed: Feb. 14, 2023

(65) Prior Publication Data

US 2023/0180944 A1 Jun. 15, 2023

Related U.S. Application Data

(62) Division of application No. 16/223,824, filed on Dec. 18, 2018, now abandoned.

(51) Int. Cl.
*A47C 27/15* (2006.01)
*A47C 21/04* (2006.01)
(Continued)

(52) U.S. Cl.
CPC ..... *A47C 27/15* (2013.01); *A47C 21/044* (2013.01); *A47C 21/048* (2013.01);
(Continued)

(58) Field of Classification Search
CPC ..... A47C 31/123; A47C 27/15; A47C 21/044; A47C 21/046; A47C 21/048; A47C 21/082; A47C 21/083
See application file for complete search history.

(56) References Cited

U.S. PATENT DOCUMENTS 5,722,482 A * 3/1998 Buckley ..... F28D 20/023 428/317.9
6,156,842 A 12/2000 Hoenig et al.
(Continued)

FOREIGN PATENT DOCUMENTS

CA 2957871 A1 7/2010
CN 201119633 Y 9/2008
(Continued)

OTHER PUBLICATIONS

Notification of Transmittal of the International Search Report and The Written Opinion of the International Searching Authority, or the Declaration, issued in International Application No. PCT/US19/65988, mailed Feb. 28, 2020; 4 pages.
(Continued)

*Primary Examiner* — Myles A Throop
(74) *Attorney, Agent, or Firm* — CANTOR COLBURN LLP

(57) ABSTRACT

Active comfort controlled bedding systems and processes of operating the bedding systems generally include a variable firmness control. The active comfort controlled bedding system can include a control unit in electrical communication with a signal generating layer configured to generate heat and alter a firmness property of at least one viscoelastic foam layer, wherein the amount of heat is based on a decrease of the glass transition temperature as a function of the percentage of humidity in the environment. In other embodiments, the bedding system is provided with at least one foam layer comprising a phase change material stratified in a foam structure of the at least one foam layer; and the at least one foam layer is heated to a temperature greater than a melt temperature of the paraffin wax to soften the at least one foam layer. In other embodiments, ambient humidity conditions can be changed.

7 Claims, 7 Drawing Sheets

(51) Int. Cl.
*A47C 27/08* (2006.01)
*A47C 31/12* (2006.01)

(52) U.S. Cl.
CPC ..... *A47C 27/082* (2013.01); *A47C 27/083* (2013.01); *A47C 31/123* (2013.01)

(56) References Cited

U.S. PATENT DOCUMENTS

| | | | | |
|---|---|---|---|---|
| 6,378,948 | B1 | 4/2002 | Macher et al. | |
| 6,449,093 | B2 * | 9/2002 | Hebrink | G02B 5/0866 252/585 |
| 6,653,363 | B1 | 11/2003 | Tursi, Jr. et al. | |
| 7,120,952 | B1 * | 10/2006 | Bass | A47C 31/105 5/500 |
| 7,793,372 | B2 | 9/2010 | Lean et al. | |
| 7,964,049 | B2 | 6/2011 | Kapur et al. | |
| 8,181,290 | B2 | 5/2012 | Brykalski et al. | |
| 8,353,069 | B1 | 1/2013 | Miller | |
| 9,326,616 | B2 | 5/2016 | Defranks et al. | |
| 9,386,862 | B1 | 7/2016 | Limer | |
| 9,980,578 | B2 | 5/2018 | Mikkelsen et al. | |
| 10,868,077 | B2 * | 12/2020 | Carroll | H10N 10/851 |
| 10,905,249 | B1 | 2/2021 | Saghiri | |
| D917,932 | S * | 5/2021 | Gluck | D6/605 |
| 11,021,567 | B2 | 6/2021 | Barksby et al. | |
| 11,229,298 | B2 | 1/2022 | Pearce | |
| 12,150,580 | B2 * | 11/2024 | Cheng | A47G 9/1036 |
| 12,167,795 | B2 * | 12/2024 | Chunglo | A47C 21/048 |
| 2002/0005986 | A1 | 1/2002 | Hebrink et al. | |
| 2008/0277057 | A1 | 11/2008 | Montgomery et al. | |
| 2010/0011502 | A1 | 1/2010 | Brykalski et al. | |
| 2011/0252562 | A1 | 10/2011 | Mikkelsen et al. | |
| 2011/0289683 | A1 | 12/2011 | Mikkelsen et al. | |
| 2012/0017376 | A1 | 1/2012 | Mikkelsen et al. | |
| 2013/0269106 | A1 | 10/2013 | Brykalski et al. | |
| 2013/0312806 | A1 | 11/2013 | Carroll | |
| 2013/0317399 | A1 | 11/2013 | Ribble et al. | |
| 2014/0141233 | A1 | 5/2014 | Crawford et al. | |
| 2014/0201925 | A1 | 7/2014 | Tursi, Jr. et al. | |
| 2015/0067967 | A1 * | 3/2015 | Tyree | A47C 27/15 5/691 |
| 2016/0270544 | A1 * | 9/2016 | DeFranks | A47C 21/044 |
| 2017/0135494 | A1 | 5/2017 | Defranks et al. | |
| 2018/0014585 | A1 * | 1/2018 | Polonio | A41D 27/00 |
| 2018/0027981 | A1 * | 2/2018 | Sherman | A47C 21/044 |
| 2018/0313080 | A1 | 11/2018 | Schmetzer et al. | |
| 2020/0187670 | A1 | 6/2020 | Defranks | |

FOREIGN PATENT DOCUMENTS

| | | | |
|---|---|---|---|
| CN | 102537646 | A | 7/2012 |
| CN | 106170228 | A | 11/2016 |
| WO | 2010075230 | A2 | 7/2010 |
| WO | 2012172085 | A2 | 12/2012 |
| WO | 2014105687 | A1 | 7/2014 |
| WO | 2019092741 | A1 | 5/2019 |

OTHER PUBLICATIONS

Written Opinion of the International Searching Authority, issued in International Application No. PCT/US19/65988, mailed Feb. 28, 2020; 15 pages.

Yu et al., "The effect of moisture bsorption on the physical properties of polyurethane shape memory polymer foams," U.S. National Library of Medicine, NIH, 2011.

Yu et al., "The Effect of Moisture on the Physicl Properties of Polyurethane Shape Memory Polymer Foams: Society For Biomaterials", 2011.

Yu, Ya-Jen, "The Effect of Moisture Absorption on the Physical Properties of Polyurethane Shape Memory Polymer Foams," 2012.

* cited by examiner

ACTIVE COMFORT CONTROLLED BEDDING SYSTEMS

CROSS REFERENCE TO RELATED APPLICATION

This application is a divisional application of U.S. patent application Ser. No. 16/223,824, filed Dec. 18, 2018, which is incorporated by reference in its entirety herein.

BACKGROUND

The present disclosure generally relates to active comfort controlled bedding systems. More particularly, the present invention relates to active comfort controlled bedding systems including a mattress core including at least one foam layer having variable firmness properties in response to a signal.

Varieties of mattress constructions are well known and are generally supplied in different degrees of firmness. For example, some mattresses are extremely soft and yieldable, i.e., plush, while others are relatively rigid and unyielding, i.e., firm. Once a mattress of a particular firmness has been purchased, it cannot generally be changed without the necessity of having to purchase another mattress. Individual preferences desired by one or two people sleeping on one mattress surface for comfort or to address pain or life changing events is often not fulfilled by current mattress designs.

The problem of supplying mattresses with various degrees of firmness is a considerable one. This applies to manufacturers and retailers who are typically required to maintain a large inventory of mattresses with different degrees of firmness. In addition, considerable difficulty arises with respect to hotels and the like, which are often required to satisfy the particular requirements or tastes of its guests as to the firmness of the mattress in a particular room. For these reasons, it is desirable to provide a single mattress, which easily adjusts to provide different degrees of firmness.

Typical foam layers used by conventional bedding manufacturers in mattresses have attempted to compensate for the infinite combination of consumer preferences by releasing several models of firmness for each bedding line, wherein the foam layers are selected to have a uniform and static firmness level. With regard to the use of foam layers used in mattresses, these materials are typically specified to have a glass transition temperature (Tg) below 72° F. with no regard to humidity levels. In some instances, the foam layers have a glass transition lower than 72° F. to account for end users' preference to keep the bedroom cooler during use.

BRIEF SUMMARY

Disclosed herein are active comfort controlled bedding systems. In one or more embodiments, the active comfort controlled bedding system includes at least one viscoelastic foam layer having a glass transition temperature greater than 60° F. at 0% humidity, wherein the active comfort controlled bedding system is in an environment having greater than 0% humidity; a signal generating layer underlying the at least one viscoelastic foam, the signal generating layer comprising a thermoelectric fabric, a heat transfer device, or a resistive heating element; and a control unit in electrical communication with the signal generating layer configured to generate heat and alter a firmness property of the at least one viscoelastic foam layer, wherein the amount of heat is based on a decrease of the glass transition temperature as a function of the percentage of humidity in the environment.

In one or more embodiments, the active comfort controlled bedding system includes at least one foam layer comprising a phase change material stratified in a foam structure of the at least one foam layer; a signal generating layer underlying the at least one foam layer, the signal generating layer comprising a thermoelectric fabric, a heat transfer device, or a resistive heating element; and a control unit in electrical communication with the signal generating layer effective to heat the phase change material above a melting temperature thereof and alter a firmness property of the at least one foam layer.

In one or more embodiments, a process for changing a firmness property of a viscoelastic foam layer in a mattress assembly includes providing the mattress assembly with at least one foam layer comprising a phase change material stratified in a foam structure of the at least one foam layer; and heating the at least one foam layer to a temperature greater than a melt temperature of the phase change material to soften the at least one foam layer.

In one or more embodiments, the process for changing a firmness property of a viscoelastic foam layer in a mattress assembly includes providing the mattress assembly with at least one viscoelastic foam layer having a first glass transition temperature greater than 60° F. at 0% humidity, and a second glass transition temperature different than the first glass transition temperature at a % humidity greater than 0, and wherein heating the viscoelastic foam layer comprises heating above the second glass transition temperature to alter the firmness property.

In one or more embodiments, a process for changing a firmness property of a foam layer in a mattress assembly includes providing the mattress assembly with at least one viscoelastic foam layer having a first glass transition temperature greater than 60° F. at 0% humidity, and a second glass transition temperature less than the first glass transition temperature at a % humidity greater than 0, and heating the at least one viscoelastic foam layer and/or changing ambient humidity conditions about the at least one viscoelastic foam layer to alter the firmness property.

The disclosure may be understood more readily by reference to the following detailed description of the various features of the disclosure and the examples included therein.

BRIEF DESCRIPTION OF THE SEVERAL VIEWS OF THE DRAWINGS

Referring now to the figures wherein the like elements are numbered alike.

DETAILED DESCRIPTION

Disclosed herein are active comfort controlled bedding systems. As will be discussed in greater detail below, the active comfort bedding systems generally include a mattress core material that is reactive to signals to provide personalized comfort. More particularly, the mattress core material includes a polymeric foam layer that has a variable firmness property in response to a thermal signal, i.e., the polymeric foam layer can be made to selectively stiffen or soften in response to a thermal signal sent to a specific zone.

Viscoelastic polymeric foam materials for use in mattresses are typically specified to have a glass transition temperature at or below 72° F. with the intent that the layer is not overly firm when first experienced by an end user. However, this specification is provided at a humidity level of 0%, i.e., a level that does not occur in actual practice. In actuality, when considering the relative humidity of the actual environment in which the mattress is used, the glass transition temperature is markedly lower than the glass transition temperature specified at 0% humidity depending on the percentage of relative humidity at the point of use.

Figure 1:
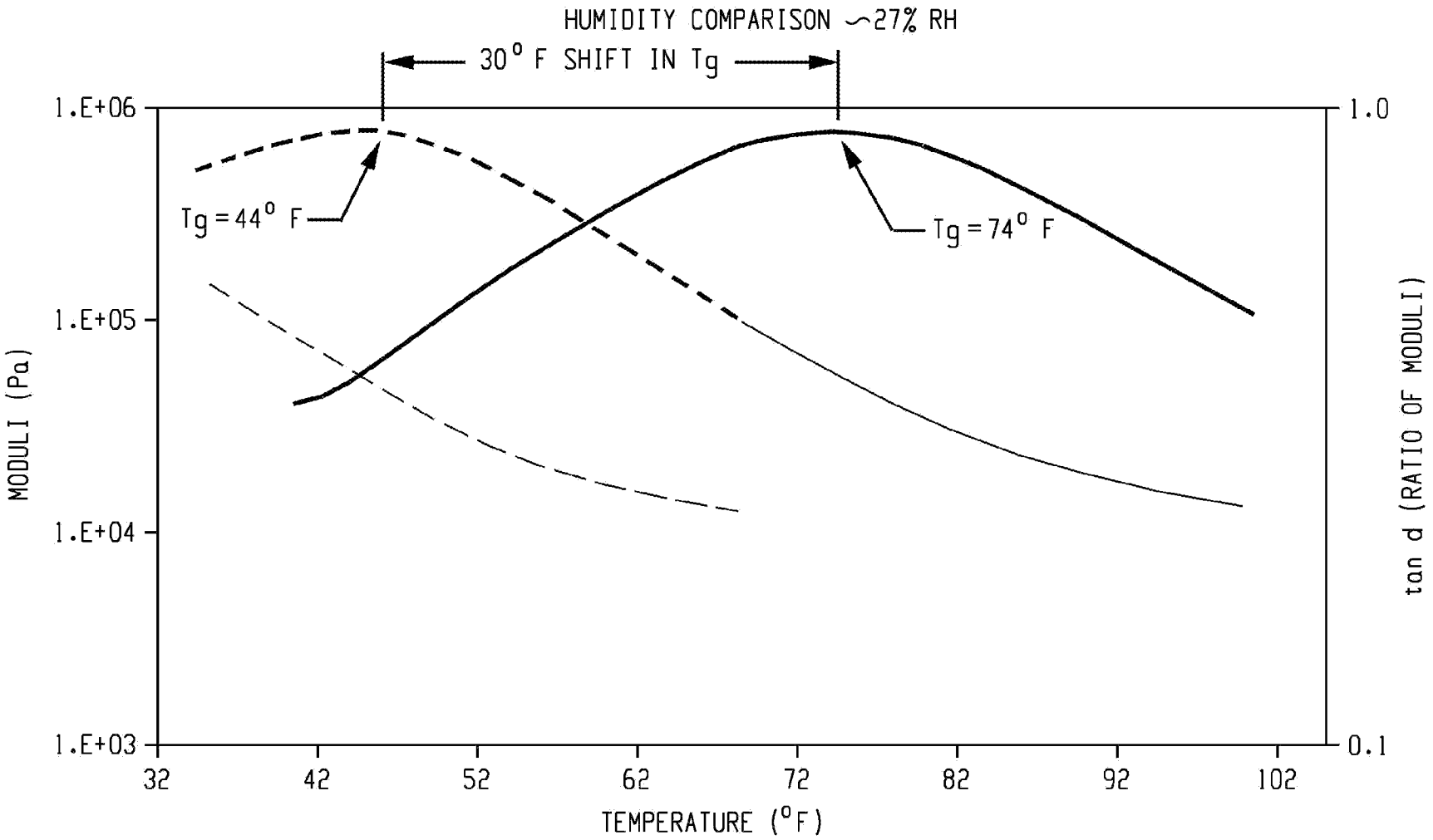
FIG. 1 graphically illustrates glass transition temperature shift of a polymeric foam as a function of relative humidity in accordance with one or more embodiments.

As graphically shown in FIG. 1, a reduction of about 30° F. in the glass transition temperature has been observed for the same viscoelastic foam as a function of increased relative humidity. That is, the same viscoelastic polymeric foam with a glass transition temperature specified at 74° F. and 0% humidity exhibited a glass transition temperature at 27% humidity of about 44° F. Storage modulus and loss modulus also decreased as a function of increased relative humidity. Consequently, viscoelastic polymeric foams for use in the present mattress core can be specified with glass transition temperatures greater than about 72° F. at 0% humidity in mattress applications given the effect that relative humidity has been found to have on the glass transition temperature. As a result, the firmness property of the viscoelastic polymeric foam having glass transition temperatures greater than about 72° F. at 0% humidity can be modulated upon application of a thermal signal, which can be controlled by the end user depending on his/her preferences so as to provide a firmer or softer feel to the viscoelastic polymeric foam layer.

In one or more embodiments, the viscoelastic polymeric foam layer is specified to have a glass transition temperature at 0% humidity greater than about 72° F. In one or more other embodiments, the viscoelastic polymeric foam is specified to have a glass transition temperature at 0% humidity greater than 80° F., and in still one or more other embodiments, the viscoelastic polymeric foam is specified to have a glass transition temperature at 0% humidity greater than 90° F. The increased glass transition temperature of the viscoelastic polymeric foams for mattress applications allows the end user to adjust the firmness property of the viscoelastic polymeric foam by application of a thermal signal that radiates heat to the viscoelastic polymeric foam layer in an amount effective to soften the viscoelastic foam. The amount effective to soften the viscoelastic foam generally depends on the relative humidity level in which the viscoelastic polymeric foam is used, which is depressed relative to the original specification at 0% humidity.

Figure 2:
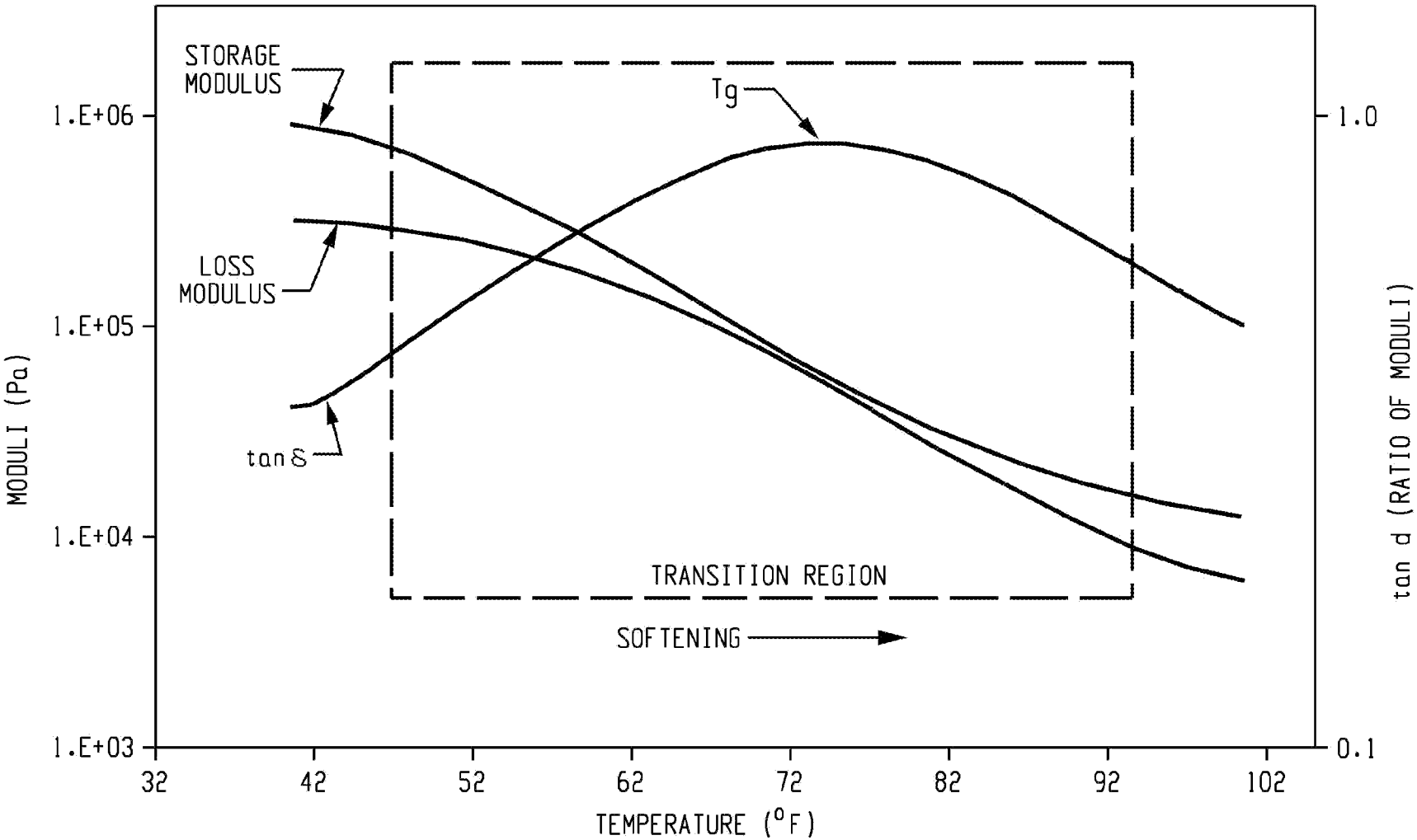
FIG. 2 graphically illustrates the glass transition temperature, storage modulus, and loss modulus shift of a polymeric foam as a function of temperature in accordance with one or more embodiments.

As graphically shown in FIG. 2, the glass transition temperature (Tg) as applied to viscoelastic polymeric foams is a temperature region in which the foam transitions from firm to soft, which is often reported as the peak of the tan & curve, which can generally be defined as the loss modulus (viscous behavior)/storage modulus (solid-like behavior). In the Figure, softening occurs for a particular viscoelastic polymer as the temperature is increases above about 72° F. As a result, the mattress core including the viscoelastic polymeric foam can be tailored to an end user's preferences so as to provide a desired firmness. With the application of heat, a firm foam (i.e., one with a high Tg and high hardness) can be softened by forcing it to progress through the phase change provided by heating the viscoelastic polymer foam to a temperature greater than its glass transition temperature.

Figure 3:
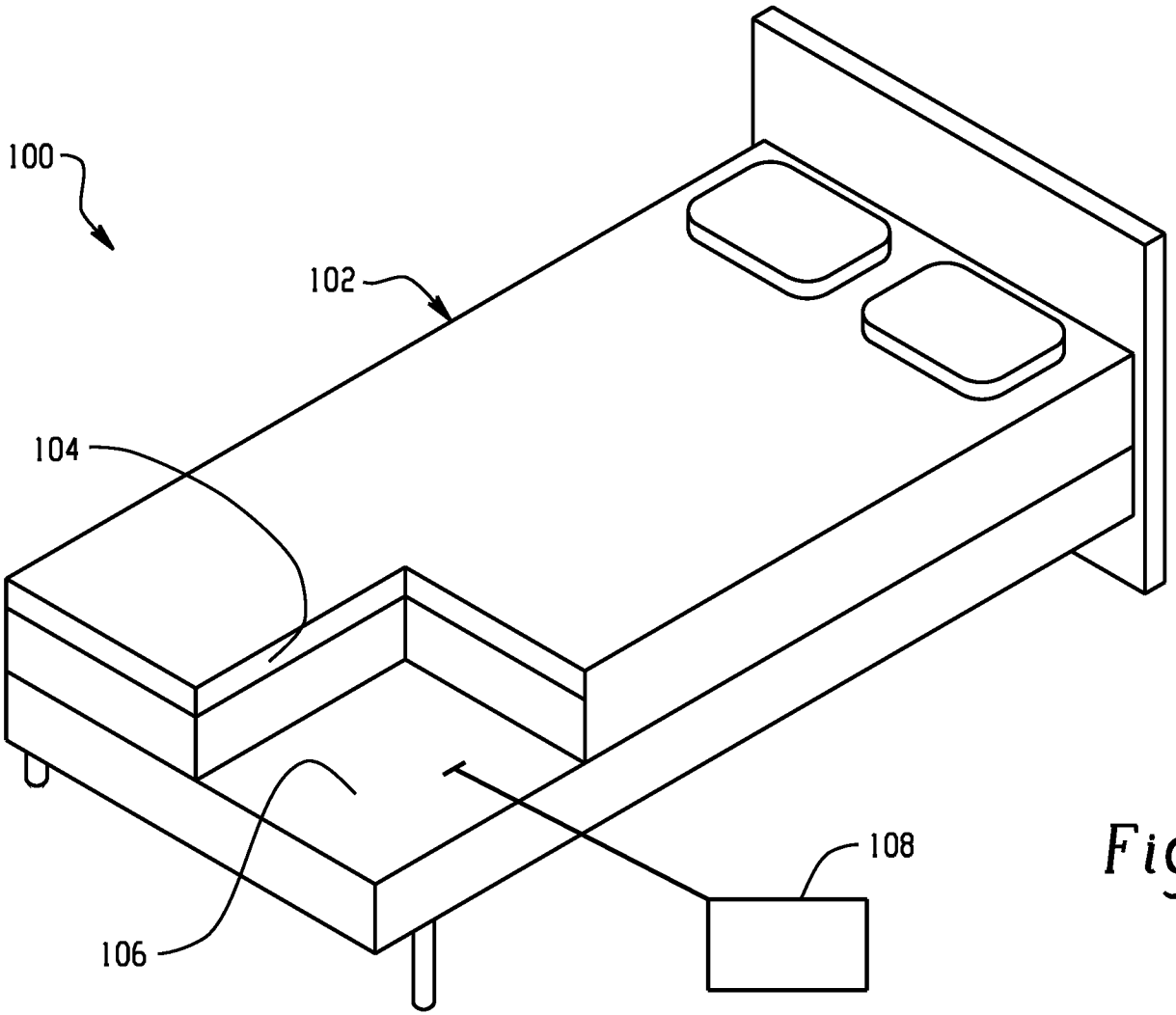
FIG. 3 is a partial perspective cut away view of a mattress including an active comfort layer in accordance with one or more embodiments.

FIG. 3 shows an exemplary mattress assembly 100 with a mattress core 102, at least one adjustable comfort foam layer 104, and a signal generating layer 106. The mattress core 102 can be constructed of a variety of resiliently compressible materials such as an innerspring coil assemblies, foam layers and combinations thereof. Exemplary innerspring coil assemblies include, without limitation, a type referred to as Marshall construction consisting of a plurality of coil springs housed within fabric pockets arranged in a closely packed connected array.

The mattress core foam layers are generally fabricated from polymers and generally include latex, polyurethane, viscoelastic foam (also referred to as memory foam), or the like. With regard to viscoelastic foams, these foams are a form of polyurethane, although with slightly different components that changes the viscosity and density to yield the "memory" characteristics. The viscoelastic property of a polymer can be studied by dynamic mechanical analysis (DMA) where a sinusoidal force (stress $\sigma$) is applied to a material and the resulting displacement (strain) is measured. For a perfectly elastic solid, the resulting strain and the stress will be perfectly in phase. For a purely viscous fluid, there will be a 90-degree phase lag of strain with respect to stress. Viscoelastic polymers have the characteristics in between where some phase lag will occur during DMA tests. Varying the composition of monomers and cross-linking defining the viscoelastic foam layer can add or change the functionality of a polymer that can alter the results obtained from dynamic mechanical analysis.

In one or more embodiments, the adjustable comfort foam layer 104 is a viscoelastic polymeric foam layer, wherein the viscoelastic polymeric foam is specified to have a glass transition temperature at 0% humidity of about 60° F. or greater. In one or more embodiments, the viscoelastic polymeric foam is specified to have a glass transition temperature at 0% humidity greater than 80° F., and in still one or more other embodiments, the viscoelastic polymeric foam is specified to have a glass transition temperature at 0% humidity greater than 90° F.

In one or more other embodiments the adjustable comfort foam layer 104 is a non-viscoelastic foam or the viscoelastic foam as described above, wherein a phase change material such as encapsulated paraffin wax pellets or other phase change material or combination of phase change materials can be stratified into the foam structure that would 'melt' in response to a thermal signal from the signal generating layer, thereby making the foam/wax composite structure softer.

The adjustable comfort foam layer 104 can be one of many layers defining the mattress core and is oftentimes surrounded by a quilted fabric or ticking, which generally serves as an outer decoration as well as holds the parts of the mattress together as one whole mattress. Additionally (not shown), the whole mattress is typically surrounded by a quilted cover, for added comfort and aesthetics. The bedding systems may be of any size, including standard sizes such as a twin, full, queen, oversized queen, king, or California king sized mattress, as well as custom or non-standard sizes constructed to accommodate a particular user or a particular room. The active comfort controlled bedding systems can be configured as one sided having defined head, foot and torso (i.e., lumbar) regions.

Suitable foams for the different layers including the adjustable comfort layer that include foam, include but are not limited to, polyurethane foams, latex foams including natural, blended and synthetic latex foams; polystyrene foams, polyethylene foams, polypropylene foam, polyether-polyurethane foams, and the like. Likewise, the foam can be selected to be viscoelastic or non-viscoelastic foams. Some viscoelastic materials are also temperature-sensitive, thereby also enabling the foam layer to change hardness/firmness based in part upon the temperature of the supported part. Unless otherwise noted, any of these foams may be open celled or closed cell or a hybrid structure of open cell and closed cell. Likewise, the foams can be reticulated, partially reticulated or non-reticulated foams. The term reticulation generally refers to removal of cell membranes to create a cell structure that is open to air and moisture flow. Still further, the foams may be gel-infused, may include conductive materials, may include phase change materials, or may include other additives in some embodiments. The different layers can be formed of the same material configured with different properties or different materials.

The various foams suitable for use in the foam layer may be produced according to methods known to persons ordinarily skilled in the art. For example, polyurethane foams are typically prepared by reacting a polyol with a polyisocyanate in the presence of a catalyst, a blowing agent, one or more foam stabilizers or surfactants and other foaming aids. The gas generated during polymerization causes foaming of the reaction mixture to form a cellular or foam structure. Latex foams are typically manufactured by the well-known Dunlap or Talalay processes. Manufacturing of the different foams are well within the skill of those in the art.

The different properties for each layer defining the foam may include, but are not limited to, density, hardness, thickness, support factor, flex fatigue, air flow, glass transition temperature, various combinations thereof, and the like. Density is a measurement of the mass per unit volume and is commonly expressed in pounds per cubic foot. By way of example, the density of the each of the foam layers can vary. In some embodiments, the density decreases from the lower most individual layer to the uppermost layer. In other embodiments, the density increases. In still other embodiments, the density is non-uniform between adjacent layers. In still other embodiments, one or more of the foam layer can have a convoluted surface. The convolution may be formed of one or more individual layers with the foam layer, wherein the density is varied from one layer to the next. The hardness properties of foam are referred to as the indentation force deflection (IFD) and is measured in accordance with ASTM D-3574. Like the density property, the hardness properties can be varied in a similar manner. Moreover, combinations of properties may be varied for each individual layer. The individual layers can also be of the same thickness or may have different thicknesses as may be desired to provide different tactile responses.

In some embodiments, the adjustable comfort foam layer can be a component of the mattress core.

The hardness of the layers generally have an indention force deflection (IFD) of 7 to 22 pounds force for viscoelastic foams and an IFD of 7 to 65 pounds force for non-viscoelastic foams. IFD can be measured in accordance with ASTM D 3574. The density of the layers can generally range from about 0.8 to 2.5 pounds per cubic foot for non-viscoelastic foams and 1.5 to 8 pounds per cubic foot for viscoelastic foams.

The signal generating layer 106 is shown underlying the mattress core 102. However, it should be noted that the signal generating layer 106 can be singular or plural, and be included anywhere within the mattress assembly including but not limited to the mattress, the mattress foundation, intermediate the mattress and mattress foundation, or combinations thereof. The at least one adjustable comfort foam layer 104 is typically located at or in close proximity to the support surface. The signal generating layer 106 can include a resistive heating element, a thermoelectric fabric layer, or a heat transfer device and can be in contact with or spaced apart from the adjustable comfort foam layer so long as the adjustable comfort foam layer can be heated in an amount sufficient to change the firmness property. Moreover, the signal generating layer 106 can be compartmentalized into different zones to change the firmness within a particular zone or multiple zones of the foam layer. Likewise, the signal generating layer 106 can be configured to provide different zones. A control unit 108 is electronically connected to the heat source and can be programmed to adjust the heat as desired.

As noted above, the signal generating layer 106 can be a resistive heating element, a thermoelectric fabric or a heat transfer device.

Flexible thermoelectric fabrics have been developed for use in various applications. For example and without limitation, thermoelectric fabrics are disclosed in U.S. Publication No. 2013/0312806, which is titled "Thermoelectric Apparatus and Applications Thereof" and is hereby incorporated by reference in its entirety. These flexible thermoelectric fabrics can employ a layered p-n junction material to generate temperature gradients from electricity. Modules of the material may be arranged in series, parallel or a combination in order to achieve the desired temperature distribution. The thermoelectric fabric remains flexible due to its polymeric construction. This allows for retained comfort when placing the layers closer to the surface of the mattress where the body is generating heat. Thermoelectric fabrics can also cover an entire sleep surface if needed. This can decrease the positional requirements of the sleeper allowing them to move freely in the mattress while still experiencing uniform temperature distribution.

Flexible, polymer-based thermoelectric fabrics can be constructed through the lamination of doped p- and n-junction polymers, or other materials, separated by an insulating material. These laminated modules can be stacked and arranged in series, parallel or a combination in order to achieve the desired temperature distribution. Polymer based thermoelectric fabrics can be placed nearer the surface of a mattress to increase efficiency of the cooling or heating process.

Figure 4:
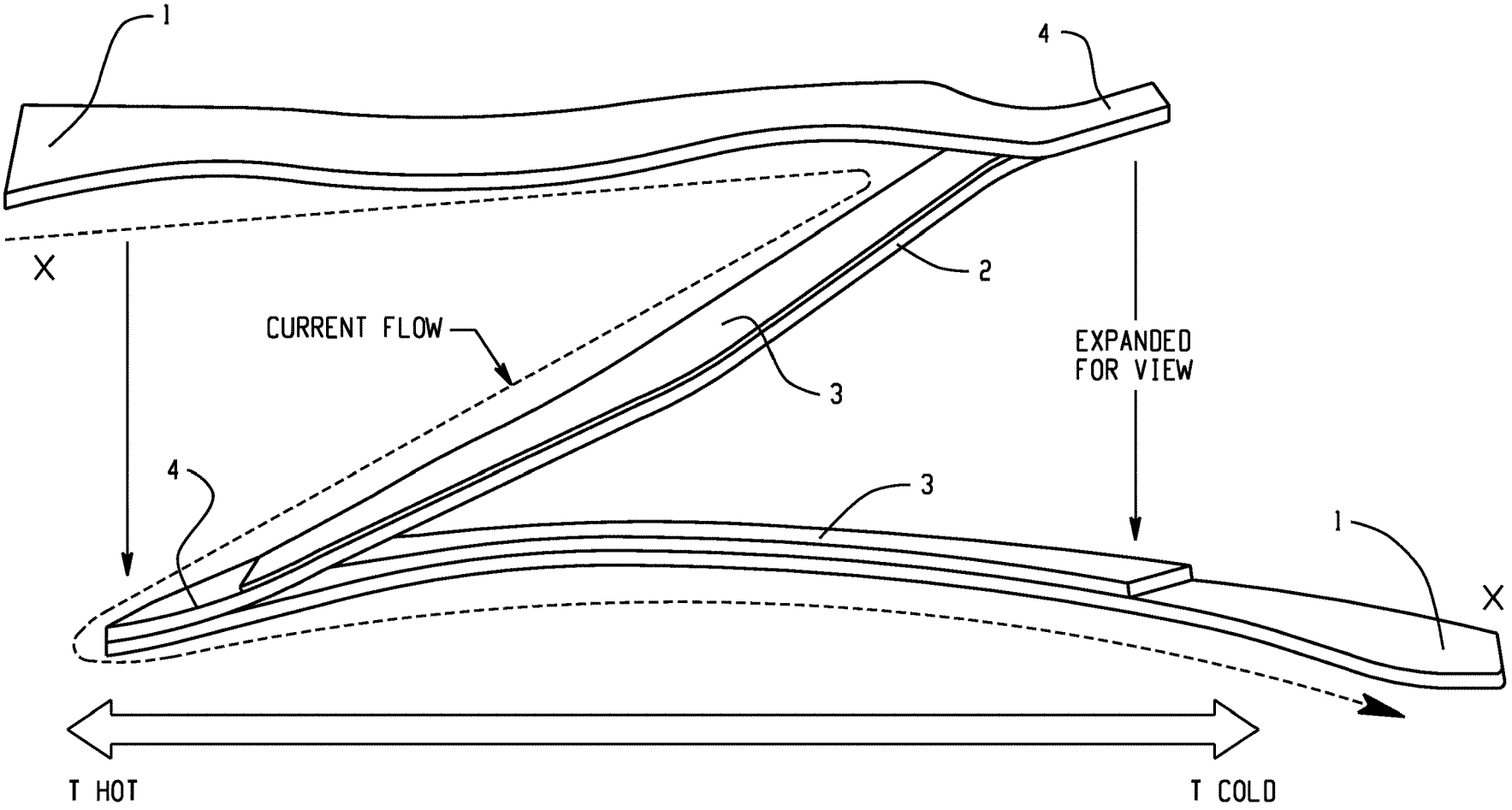
FIG. 4 is a side perspective view of an expanded thermoelectric apparatus that can integrated into a flexible fabric in accordance with one or more embodiments.

As is explained in greater detail in U.S. Publication No. 2013/0312806, FIG. 4 illustrates an expanded side view of a thermoelectric apparatus that forms example flexible thermoelectric fabrics. The thermoelectric apparatus illustrated in FIG. 4 comprises two p-type layers 1 coupled to an n-type layer 2 in an alternating fashion. The alternating coupling of p-type 1 and n-type 2 layers provides the thermoelectric apparatus a z-type configuration having p-n junctions 4 on opposite sides of the apparatus. Insulating layers 3 are disposed between interfaces of the p-type layers 1 and the n-type layer 2 as the p-type 1 and n-type 2 layers are in a stacked configuration. As shown, the thermoelectric apparatus provided in FIG. 4 is in an expanded state to facilitate illustration and understanding of the various components of the apparatus. In some aspects, however, the thermoelectric apparatus is not in an expanded state such that the insulating layers 3 are in contact with a p-type layer 1 and an n-type layer 2.

FIG. 4 additionally illustrates the current flow through the thermoelectric apparatus which is resultant to exposing the thermoelectric apparatus to a temperature differential across both sides. It is also possible that current flow causes said temperature differential. Electrical contacts X are provided to the thermoelectric apparatus for application of the thermally generated current to an external load or to cause the temperature differential due to a current from an external power source.

Figure 5:
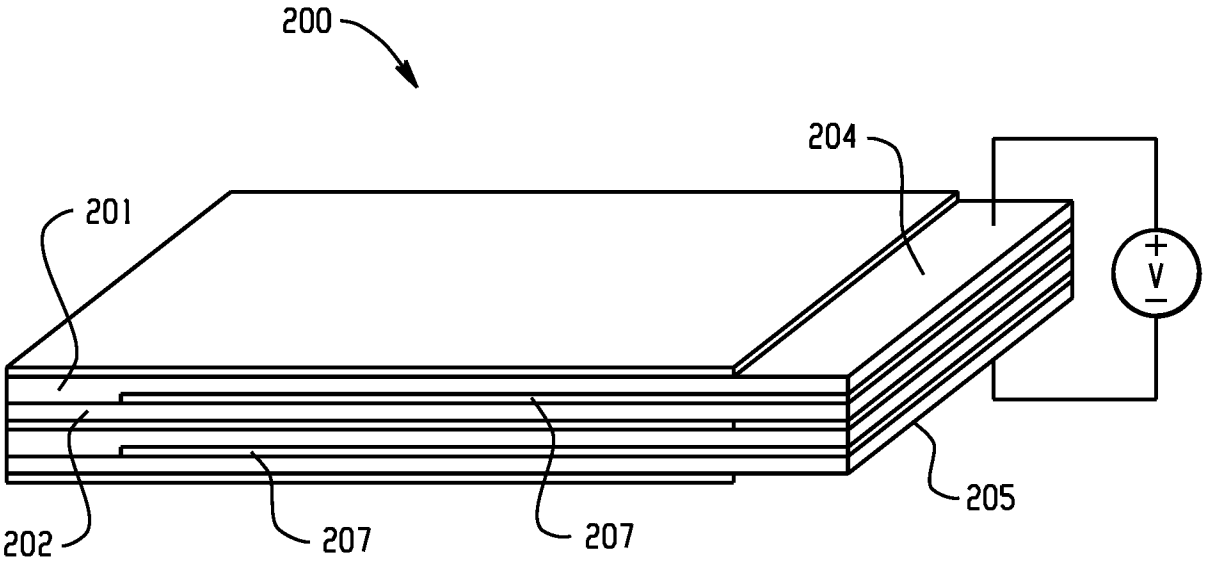
FIG. 5 is an exemplary flexible thermoelectric fabric in accordance with one or more embodiments.

Again, as is explained in greater detail in U.S. Publication No. 2013/0312806, FIG. 5 illustrates an exemplary thermoelectric apparatus 200, wherein the p-type layers 201 and the n-type layers 202 are in a stacked configuration. The p-type layers 201 and the n-type layers 202 can be separated by insulating layers 207 in the stacked configuration. The thermoelectric apparatus 200 can be connected to an external load by electrical contacts 204, 205.

Figure 6:
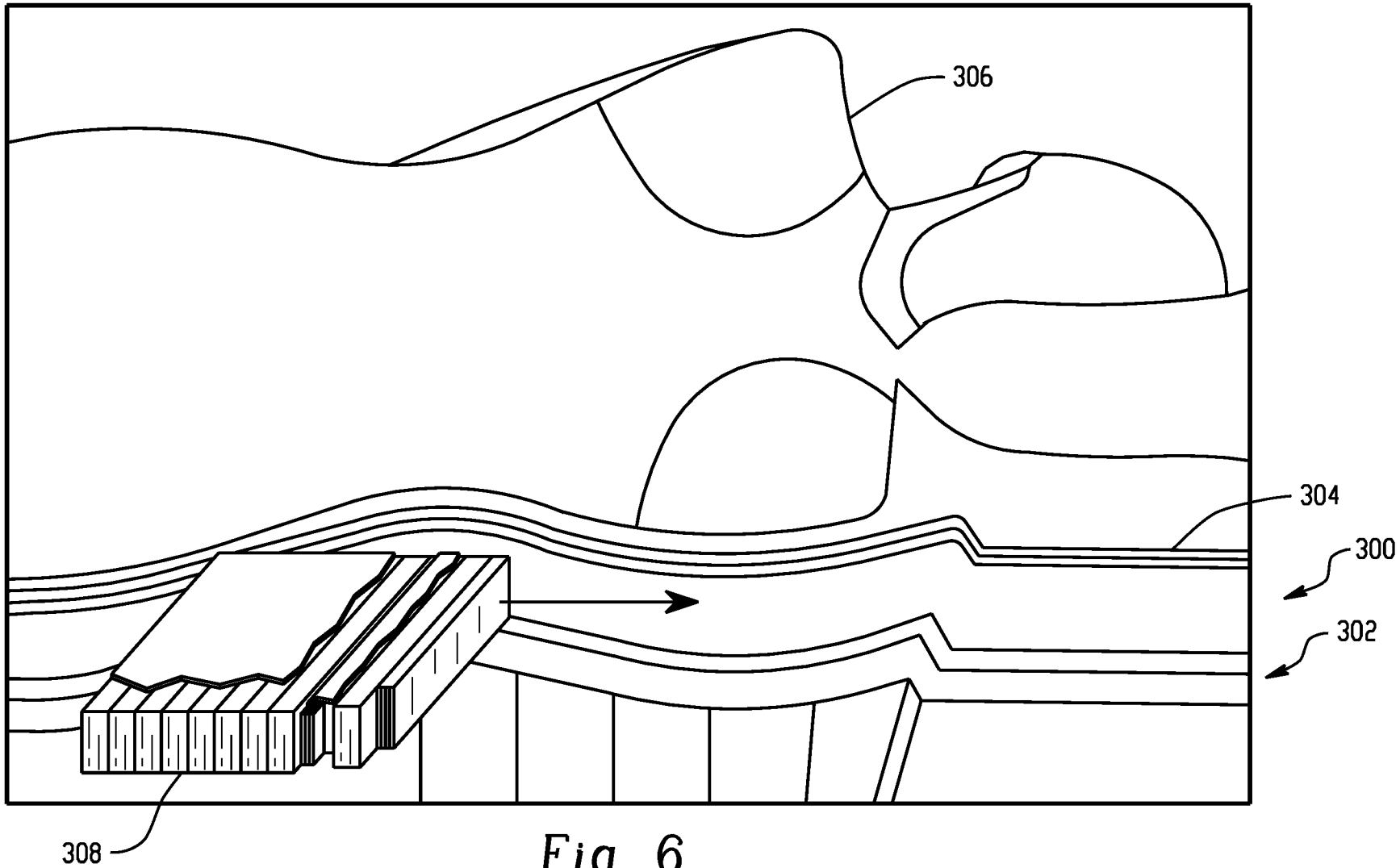
FIG. 6 is a perspective cut-away view of an exemplary mattress assembly that includes a flexible thermoelectric fabric in accordance with one or more embodiments.

FIG. 6 illustrates an exemplary flexible thermoelectric fabric 300. The flexible thermoelectric fabric 300 can include a thermoelectric apparatus as described above with respect to FIGS. 1-2 such that the apparatus forms a fabric that is capable of bending easily without breaking the circuits. As such, in some aspects, the flexible thermoelectric fabric can comprise at least one p-type layer coupled to at least one n-type layer to provide a p-n junction, and an insulating layer at least partially disposed between the p-type layer and the n-type layer, the p-type layer comprising a plurality of carbon nanoparticles and the n-type layer comprising a plurality of n-doped carbon nanoparticles. In some aspects, carbon nanoparticles of the p-type layer are p-doped and carbon nanoparticles of the n-type layer are n-doped. In some aspects, a p-type layer of a flexible thermoelectric fabric or apparatus can further comprise a polymer matrix in which the carbon nanoparticles are disposed. In some aspects, an n-type layer further comprises a polymer matrix in which the n-doped carbon nanoparticles are disposed. In some aspects, p-type layers and n-type layers of a flexible thermoelectric fabric or apparatus described herein are in a stacked configuration.

In some aspects, carbon nanoparticles of a p-type layer comprise fullerenes, carbon nanotubes, or mixtures thereof. In some aspects, carbon nanotubes can comprise single-walled carbon nanotubes (SWNT), multi-walled carbon nanotubes (MWNT), as well as p-doped single-walled carbon nanotubes, p-doped multi-walled carbon nanotubes or mixtures thereof. N-doped carbon nanoparticles can comprise fullerenes, carbon nanotubes, or mixtures thereof. In some aspects, n-doped carbon nanotubes can also comprise single-walled carbon nanotubes, multi-walled carbon nanotubes or mixtures thereof.

In some aspects, a p-type layer and/or n-type layer can further comprise a polymeric matrix in which the carbon nanoparticles are dispersed. Any polymeric material consistent with the objectives of the present invention can be used in the production of a polymeric matrix. In some aspects, a polymeric matrix comprises a fluoropolymer including, but not limited to, polyvinyl fluoride (PVF), polyvinylidene fluoride (PVDF), polytetrafluoroethylene (PTFE), or mixtures or copolymers thereof. In some aspects, a polymer matrix comprises polyacrylic acid (PAA), polymethacrylate (PMA), polymethylmethacrylate (PMMA) or mixtures or copolymers thereof. In some aspects, a polymer matrix comprises a polyolefin including, but not limited to polyethylene, polypropylene, polybutylene or mixtures or copolymers thereof. A polymeric matrix can also comprise one or more conjugated polymers and can comprise one or more semiconducting polymers.

As a person of ordinary skill will understand, the "Seebeck coefficient" of a material is a measure of the magnitude of an induced thermoelectric voltage in response to a temperature difference across that material. A p-type layer, in some aspects, can have a Seebeck coefficient of at least about 3 uV/K at a temperature of 290 K. In some aspects, a p-type layer has a Seebeck coefficient of at least about 5 uV/K at a temperature of 290 K. In some aspects, a p-type layer has a Seebeck coefficient of at least about 10 μV/K at a temperature of 290 K. In some aspects, a p-type layer has a Seebeck coefficient of at least about 15 μV/K or at least about 20 μV/K at a temperature of 290 K. In some aspects, a p-type layer has a Seebeck coefficient of at least about 30 μV/K at a temperature of 290 K. A p-type layer, in some aspects, has a Seebeck coefficient ranging from about 3 μV/K to about 35 μV/K at a temperature of 290 K. A p-type layer, in some aspects, has a Seebeck coefficient ranging from about 5 μV/K to about 35 μV/K at a temperature of 290 K. In some aspects, a p-type layer has Seebeck coefficient ranging from about 10 μV/K to about 30 μV/K at a temperature of 290° K. As described herein, in some aspects, the Seebeck coefficient of a p-type layer can be varied according to carbon nanoparticle identity and loading. In some aspects, for example, the Seebeck coefficient of a p-type layer is inversely proportional to the single-walled carbon nanotube loading of the p-type layer.

Similarly, an n-type layer can have a Seebeck coefficient of at least about −3 μV/K at a temperature of 290 K. In some aspects, an n-type layer has a Seebeck coefficient at least about −5 μV/K at a temperature of 290 K. In some aspects, an n-type layer has a Seebeck coefficient at least about −10 μV/K at a temperature of 290 K. In some aspects, an n-type layer has a Seebeck coefficient of at least about −15 μV/K or at least about −20 μV/K at a temperature of 290 K. In some aspects, an n-type layer has a Seebeck coefficient of at least about −30 μV/K at a temperature of 290 K. An n-type layer, in some aspects, has a Seebeck coefficient ranging from about −3 μV/K to about −35 μV/K at a temperature of 290 K. In some aspects, an n-type layer has Seebeck coefficient ranging from about −5 μV/K to about −35 μV/K at a temperature of 290 K. In some aspects, an n-type layer has Seebeck coefficient ranging from about −10 μV/K to about −30 μV/K at a temperature of 290 K. In some aspects, the Seebeck coefficient of an n-type layer can be varied according to n-doped carbon nanoparticle identity and loading. In some aspects, for example, the Seebeck coefficient of an n-type layer is inversely proportional to the carbon nanoparticle loading of the n-type layer.

As described herein and in U.S. Publication No. 2013/0312806, in some aspects the flexible thermoelectric fabric can include an insulating layer. An insulating layer can comprise one or more polymeric materials. Any polymeric material consistent with the objectives of the present invention can be used in the production of an insulating layer. In some aspects, an insulating layer comprises polyacrylic acid (PAA), polymethacrylate (PMA), polymethylmethacrylate (PMMA) or mixtures or copolymers thereof. In some aspects, an insulating layer comprises a polyolefin including, but not limited to polyethylene, polypropylene, polybutylene or mixtures or copolymers thereof. In some aspects, an insulating layer comprises PVDF. An insulating layer can have any desired thickness consistent with the objectives of the present invention. In some aspects, an insulating layer has a thickness of at least about 50 nm. In some aspects, an insulating layer has a thickness ranging from about 5 nm to about 50 μm. Additionally, an insulating layer can have any desired length consistent with the objectives of the present invention. In some aspects, an insulating layer has a length substantially consistent with the lengths of the p-type and n-type layers between which the insulating layer is disposed. That is, in some aspects, an insulating layer, p-type layer, and/or n-type layer can have a length of at least about 1 μm. In some aspects, an insulating layer, p-type layer, and/or n-type layer can have a length ranging from about 1 μm to about 500 mm.

As shown in FIG. 6, an exemplary mattress assembly 300 having a body support 302. The body support 302 has a proximal surface 304 that can support a body 306. The body 306, as shown, can be a human body and the body support 302 can be configured to support the body in a prone, supine, semi-supine, sitting, or any other position so long as the body support 302 supports some portion of the body. The thermoelectric apparatus 308 can be provided intermediate the proximal surface 304 and the body support 302 in relative close proximity to the proximal surface 304.

Figure 7:
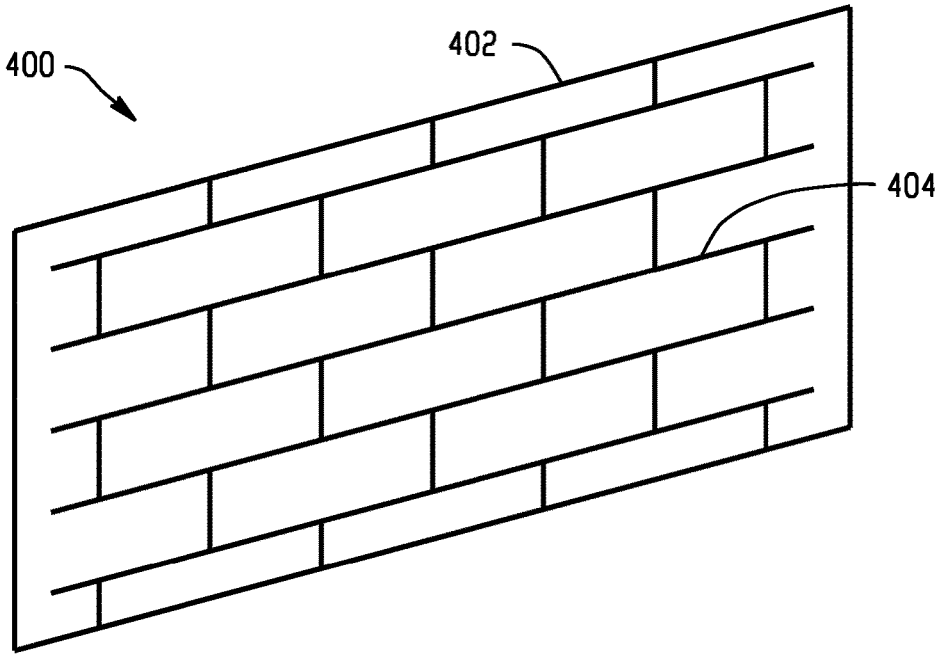
FIG. 7 is a top down view of an exemplary signal generating layer including resistive heating elements in accordance with one or more embodiments.

FIG. 7 illustrates an exemplary resistive heating element 400 formed of a flat envelope of synthetic textile material 402 containing an electric resistance wire 404 which is mostly inserted in a zigzag or meander shape but which may also have the form of a thin, flat ribbon. Alternatively, the wire 404 can be a conductive sewing thread.

Figure 8:
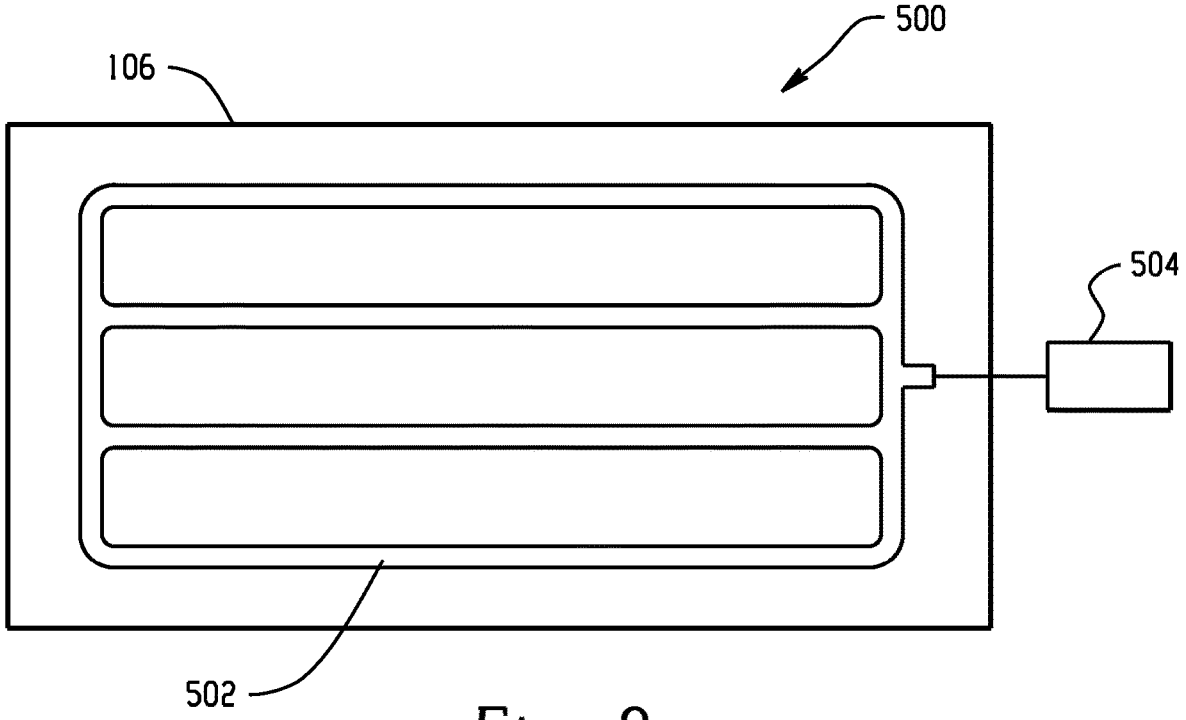
FIG. 8 is an exemplary signal generating layer including a fluid based heat transfer device in accordance with one or more embodiments.

FIG. 8 illustrates an exemplary heat transfer device 500. The particular heat transfer device is not intended to be limited and can includes a vented bladder 502 in fluid communication with a blower assembly 504 or may include multiple blower assemblies mounted within the foundation or proximate to the mattress assembly. An exemplary heat transfer devices are disclosed in U.S. Pat. No. 9,326,616, entitled "Active Airflow Temperature Controlled Bedding Systems" to Dreamwell, Ltd, and U.S. Pat. No. 8,353,069 entitled Device for Heating, Cooling and Emitting Fragrance into Bedding on a Bed, incorporated herein by reference in their entireties.

The heat transfer device can include a fluid transfer device (e.g., blower, fan, etc.), a thermoelectric device (e.g., Peltier device), a convective heater, a heat pump, a dehumidifier and/or any other type of conditioning device. In addition, the air supply can include one or more inlets and outlets (not shown) through which air or other fluid can enter or exit an interior space of the air supply. Accordingly, once air or other fluid enters the interior space of the air supply (e.g., through one or more inlets), it can be directed toward the upper layers by one or more fluid conduits and ventilated tubes. In embodiments where a fluid module comprises (or is in fluid communication with) a thermoelectric device or similar device, a waste fluid stream can be generated. When cooled air is being provided to the bed assembly (e.g., through one or more passages through or around the upper portion), the waste fluid stream is generally hot relative to the main fluid stream, and vice versa. Accordingly, it may be desirable, in some arrangements, to channel such waste fluid out of the interior of the air supply. For example, the waste fluid can be conveyed to one or more outlets (not shown) or other openings positioned along an outer surface of the air supply using a duct or other conduit. In arrangements, where the air supply comprises more than one thermoelectric device, the waste fluid streams from two or more of the thermoelectric devices may be combined in a single waste conduit.

The control unit 108 shown on FIG. 3 is electronically connected to the signal generating layer, e.g., heat source and can be programmed to adjust the heat as desired based on sensor data. The control unit includes control circuitry, which can include a plug that coupled to an electrical outlet (not shown) to receive local power, which in the United States could be standard 110 V, 60 Hz AC electric power supplied through a power cord. It should be understood that alternate voltage and frequency power sources may also be used depending upon where the product is sold and the local standards used therein. Control circuitry further includes power circuitry that converts the supplied AC power to power suitable for operating various circuit components of control circuitry.

The control unit can include a processor, a memory, and a transceiver and may communicate with the plurality of sensors wirelessly or via wired connections. Suitable sensors can include humidity sensors, temperature sensors, position sensors, and the like. In exemplary embodiments, the control system is configured to collect the information received from the one or more sensors in the memory. In one embodiment, the processor may be disposed within the active comfort controlled bedding system. In other embodiments, the processor may be located proximate to the active comfort controlled bedding system. The control unit can also be programmed using algorithms effective to understand (predict) the human factor (i.e. heat output, body weight and the effect that has on heat transfer through the compressed foam and location on the stress-strain curve of the foam. Additionally, the control unit can be programmed to predict a future state to adjust the amount of heat generated in the signal generating layer.

In exemplary embodiments, the processor may be a digital signal processing (DSP) circuit, a field-programmable gate array (FPGA), an application specific integrated circuits (ASICs) or the like. The processor can be any custom made or commercially available processor, a central processing unit (CPU), an auxiliary processor among several processors, a semiconductor based microprocessor (in the form of a microchip or chip set), a macroprocessor, or generally any device for executing instructions.

In exemplary embodiments, the control system is configured to communicate to with a user interface that a user of the active comfort controlled bedding system can use to modify one or more settings of the control system. In one embodiment, the control system includes a Bluetooth® or Wi-Fi transceiver that can be used to communicate with a wireless device or wireless network. In exemplary embodiments, the control system is configured to connect to a web-service over a Wi-Fi connection and a user of the active comfort controlled bedding systems (including variable firmness control and/or variable climate control) mattress can use the web-service to modify one or more settings of the control system and to view data collected by the control system that is stored in the memory. In exemplary embodiments, data collected by the control system may be stored locally, on a wireless device or a web-based Cloud service.

In exemplary embodiments, the one or more settings of the control system may include a desired firmness for each zone of the active comfort controlled bedding system that can be changed by altering the pressure within one or more of the air bladders. Likewise, one or more settings of the control system may include a desired climate setting corresponding to areas of the bedding system configured for air flow as discussed above, e.g., the head, lumbar, and upper leg regions. For example, it has been found that ambient air flow to the head region including the neck area of the end user can effectively increase comfort by reducing temperature via evaporative cooling as the neck area is prone to sweating when the end user feels hot. In exemplary embodiments, the user interface may allow a user to view statistics gathered on the quality of their sleep and may provide suggested changes to various climate settings to help improve the quality of the user's sleep. In exemplary embodiments, the processor may be configured to analyze the statistics gathered on the quality of a user's sleep and to make automatic adjustments to the various climate settings to help improve the quality of the user's sleep. In exemplary embodiments, the analysis of statistics can be executed on a wireless device or a web-based service.

For multi-user bedding systems, the pressure and/or temperature feedback can allow the active comfort bedding system to actively maintain a desired pressure and/or comfortable climate with respect to each occupant. Since no two occupants are identical, the system can be configured to sense the pressure and/or the surface temperature and/or relative humidity and responds accordingly rather than a one size fits all approach.

To facilitate operation of the bedding systems described above, the bedding systems can further include one or more sensors to automatically adjust to body position, which can be used to fall asleep faster and provide uninterrupted sleep. The types of sensors are not intended to be limited and may include pressure sensors, load sensors, force sensors, temperatures sensors, humidity sensors, motion sensors, vibrational piezoelectric sensors and the like.

In one or more embodiments, a process for changing a firmness property of a foam layer in a mattress assembly can include providing the mattress assembly with at least one viscoelastic foam layer having a first glass transition temperature greater than 60° F. at 0% humidity, and a second glass transition temperature less than the first glass transition temperature at a % humidity greater than 0. The at least one viscoelastic foam layer can be heated and/or the ambient humidity conditions about the at least one viscoelastic foam layer can be changed to alter the firmness property. For example, the at least one viscoelastic foam layer can be heated above the second glass transition temperature and/or the ambient humidity conditions can be increased by mixing air about the mattress assembly with moisture and exposing the at least one viscoelastic foam layer with the air and/or the ambient humidity conditions can be decreased by removing moisture from air and exposing the at least one viscoelastic foam layer with the air. The term ambient humidity conditions generally refers to an environment in which the mattress assembly is disposed.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A process for changing a firmness property of a foam layer in a mattress assembly, the process comprising:

providing the mattress assembly with one or more layers, wherein at least one of the one or more layers is an adjustable comfort foam layer comprising a phase change material stratified within a foam structure of the adjustable comfort layer; and heating the adjustable comfort foam layer with a device to a temperature greater than a melt temperature of the phase change material to soften the adjustable comfort foam layer, wherein heating the adjustable comfort foam layer comprises generating heat from a thermoelectric fabric comprising layered p-n junction material laminated into a fabric structure underlying the at least one foam layer, wherein the heating is controlled by a feedback system responsive to a plurality of sensors measuring at least a humidity condition and a temperature condition about the adjustable comfort foam layer and changing at least one of the humidity condition and temperature condition to alter the firmness of the adjustable comfort foam layer.

2. The process of claim 1, wherein heating the adjustable comfort foam layer comprises generating heat from a heat transfer device underlying the adjustable comfort foam layer, wherein the heat transfer device is activated in response to a detected change in firmness below a predetermined threshold.

3. The process of claim 1, wherein heating the adjustable comfort foam layer comprises generating heat from a layer comprising resistive heating elements underlying the adjustable comfort foam layer, wherein the resistive heating elements are arranged in a pattern corresponding to the stratification of the phase change material.

4. The process of claim 1, wherein the at least one or more layers comprises a viscoelastic foam layer having a first glass transition temperature greater than 60° F. at 0% humidity, and a second glass transition temperature less than the first glass transition temperature at a % humidity greater than 0, and wherein heating the viscoelastic foam layer comprises heating above the second glass transition temperature to alter the firmness property.

5. A process for changing a firmness property of a viscoelastic foam layer in a mattress assembly, the process comprising:

providing the mattress assembly with at least one viscoelastic foam layer having a first glass transition temperature greater than 60° F. at 0% humidity, and a second glass transition temperature less than the first glass transition temperature at a % humidity greater than 0, the at least one viscoelastic foam layer comprising a phase change material stratified in a foam structure of the at least one viscoelastic foam layer; and heating the at least one viscoelastic foam layer comprises heating above the second glass transition temperature and below the first glass transition temperature to alter the firmness property, wherein heating the at least one viscoelastic foam layer comprises generating heat from a thermoelectric fabric comprising layered p-n junction material laminated into a fabric structure underlying the at least one viscoelastic foam layer, wherein the heating is controlled by a feedback system responsive to a plurality of sensors measuring at least a humidity condition and a temperature condition about the at least one viscoelastic foam layer and changing at least one of the humidity condition and temperature condition to alter the firmness of the viscoelastic foam layer.

6. The process of claim 5, wherein heating the at least one viscoelastic foam layer comprises generating heat from a heat transfer device underlying the at least one viscoelastic foam layer, wherein the heat transfer device is activated in response to a detected change in firmness below a predetermined threshold.

7. The process of claim 5, wherein heating the at least one viscoelastic foam layer comprises generating heat from a layer comprising resistive heating elements underlying the at least one viscoelastic foam layer, wherein the resistive heating elements are arranged in a pattern corresponding to the stratification of the phase change material.

* * * * *